US005901544A

United States Patent [19]

McNeill

[11] Patent Number: 5,901,544

[45] Date of Patent: May 11, 1999

[54] METHOD AND APPARATUS FOR PRODUCING RANDOMLY VARIEGATED MULTIPLE STRAND TWISTED YARN AND YARN AND FABRIC MADE BY SAID METHOD

[75] Inventor: William A. McNeill, Gastonia, N.C.

[73] Assignee: Caress Yarns, Inc., Charlotte, N.C.

[21] Appl. No.: 08/798,107

[22] Filed: Feb. 12, 1997

Related U.S. Application Data

[63] Continuation-in-part of application No. 08/599,801, Feb. 12, 1996, Pat. No. 5,673,549, which is a continuation-in-part of application No. 08/297,252, Aug. 26, 1994, Pat. No. 5,619,849.

[51] Int. Cl.[6] ..... D01H 1/24

[52] U.S. Cl. ..... 57/341; 28/252; 57/3; 57/6; 57/11; 57/12; 57/13; 57/79; 57/293; 57/334; 57/342

[58] Field of Search ..... 57/328, 204, 205, 57/206, 208, 283, 293, 78, 350, 333, 81, 79, 95, 98, 99, 908, 3, 6, 11, 12, 13, 334, 341, 342, 344, 345; 28/252

[56] References Cited

U.S. PATENT DOCUMENTS

| | | | |
|---|---|---|---|
| Re. 31,808 | 1/1985 | London et al. | 57/6 |
| 2,936,570 | 5/1960 | Arthur et al. | 57/342 |
| 3,745,755 | 7/1973 | Keto | 57/341 |
| 3,748,648 | 7/1973 | Pugh | 340/172.5 |
| 3,756,006 | 9/1973 | Heinroth et al. | 57/341 |
| 4,083,172 | 4/1978 | Norris et al. | 57/34 |
| 4,142,357 | 3/1979 | Poston | 57/122 |
| 4,164,836 | 8/1979 | Tanae et al. | 57/2 |
| 4,169,350 | 10/1979 | Yamana et al. | 57/350 |
| 4,186,898 | 2/1980 | Wilson et al. | 242/152.1 |
| 4,206,589 | 6/1980 | Markey et al. | 57/293 |
| 4,212,152 | 7/1980 | Roman | 57/207 |
| 4,218,869 | 8/1980 | Newton | 57/245 |
| 4,223,520 | 9/1980 | Whitted et al. | 57/350 |
| 4,228,639 | 10/1980 | Hunt et al. | 57/341 |
| 4,313,578 | 2/1982 | Van Wilson et al. | 242/149 |
| 4,330,988 | 5/1982 | Eschenbach | 57/6 |
| 4,472,931 | 9/1984 | Stahlecker | 57/18 |
| 4,484,433 | 11/1984 | Stahlecker et al. | 57/15 |
| 4,484,435 | 11/1984 | Fritjof | 57/315 |
| 4,495,758 | 1/1985 | Stahlecker et al. | 57/19 |
| 4,569,192 | 2/1986 | Yamada et al. | 57/333 |
| 4,610,131 | 9/1986 | Eschenbach et al. | 57/6 |
| 4,663,947 | 5/1987 | Rodo | 66/213 |
| 4,698,956 | 10/1987 | Clarke et al. | 57/2 |

(List continued on next page.)

FOREIGN PATENT DOCUMENTS 2-23610 3/1982 Japan .

*Primary Examiner*—William Stryjewski
*Attorney, Agent, or Firm*—Kennedy Covington Lobdell & Hickman, L.L.P.

[57] ABSTRACT

A method and apparatus for producing randomly variegated multiple strand wrapped yarn in twisting together two or more yarns at a plurality of yarn twisting stations. At each station a pneumatic twisting head is disposed in which randomly turbulent air currents are created in a chamber in the twisting head by compressed air flowing into the chamber from a manifold through bores in the twisting head, thereby randomly twisting together two or more yarns in the chamber. The yarns which have been twisted together are wrapped with a binder yarn and then taken up over a plurality of traversing drums commonly mounted on a shaft which is driven by an alternating electric current motor controlled by a control device which operates to start and restart the motor on a predetermined cycle including a variation of the electrical input sufficient to result in randomly unpredictable inertia resistance of the traversing drums to rotational speed variation, thereby creating randomly unpredictable take-up of the yarns to produce non-uniform random twist in the yarns. The yarn produced has various lengths of opposite twist with varying degrees of twist and sections of no twist and sections of varying wrap, and the fabric produced with the yarn is randomly variegated with no repeating pattern.

37 Claims, 9 Drawing Sheets

U.S. PATENT DOCUMENTS

| | | | |
|---|---|---|---|
| 4,807,431 | 2/1989 | Braxmeier | 57/333 |
| 4,880,175 | 11/1989 | Yamauchi et al. | 242/35.5 R |
| 4,934,134 | 6/1990 | Niederer | 57/350 |
| 4,945,718 | 8/1990 | Stahlecker et al. | 57/333 |
| 4,961,308 | 10/1990 | Braxmeier | 57/328 |
| 4,993,218 | 2/1991 | Schwartz et al. | 57/208 |
| 5,046,673 | 9/1991 | Moussalli | 242/18 R |
| 5,048,281 | 9/1991 | Dallmann et al. | 57/264 |
| 5,056,200 | 10/1991 | Schwartz et al. | 28/258 |
| 5,119,623 | 6/1992 | Fetzer et al. | 57/333 |
| 5,348,238 | 9/1994 | Yamauchi et al. | 242/18 R |
| 5,638,669 | 6/1997 | Kallmann | 57/6 |

METHOD AND APPARATUS FOR PRODUCING RANDOMLY VARIEGATED MULTIPLE STRAND TWISTED YARN AND YARN AND FABRIC MADE BY SAID METHOD

This is a continuation-in-part of U.S. patent application Ser. No. 08/599,801, filed Feb. 12, 1996, for METHOD AND APPARATUS FOR PRODUCING RANDOMLY VARIEGATED MULTIPLE STRAND TWISTED YARN AND YARN AND FABRIC MADE BY SAID METHOD, now U.S. Pat. No. 5,673,549, which is a continuation-in-part of U.S. patent application Ser. No. 08/297,252, filed Aug. 26, 1994, for METHOD AND APPARATUS FOR PRODUCING RANDOMLY VARIEGATED MULTIPLE STRAND YARN IN TWISTING TOGETHER AT LEAST TWO YARNS AND YARN AND FABRIC MADE BY SAID METHOD, now U.S. Pat. No. 5,619,849.

BACKGROUND OF THE INVENTION

The present invention relates to a method and apparatus for creating randomly variegated twisted yarn by twisting two or more yarns together, thereby preventing the development of patterning when the resulting yarn is used in textile products.

In the textile industry, two or more yarns are frequently twisted together into a single multi-ply yarn which has desirable characteristics such as improved strength, appearance, texture, wear resistance, ease of handling during manufacturing, or other properties. The yarn plies which are combined may be made up of different fibers, either natural or synthetic, or the yarns may be made up of the same type fiber but have slightly different qualities, even when unintended. The different yarn plies often have varying dye characteristics, and, if package dyeing of the combined yarn or piece dyeing is later employed, the yarn plies may attain visibly different color shades, giving the resulting product a variegated appearance. A variegated appearance may also arise from the differing texture or other properties of the individual yarn plies.

While a variegated appearance may be desirable in itself, yarn patterning tends to arise when yarn plies are combined, producing streaks or other patterns which repeat throughout the textile product in which the combined yarn is used. Yarn patterning is caused by the tendency of the yarn plies to interact with mechanical parts, such as feed rollers and traversing drums, in a uniform repeating pattern, which has been difficult to avoid.

U.S. Pat. No. 4,934,134 to Niederer describes one approach to controlling yarn patterning in which a vortex is employed to randomly twist strands together with varying air pressure controlled by an air controller and a beater interposed in the path of the yarn to randomize the yarn strands. This approach requires an air controller and a mechanical beater which likely results in some ultimate repeating pattern. Further, the Niederer patent does not suggest varying the rate of take-up of the yarn as a means for varying the twist in the plied yarn.

For some purposes it is desirable to provide a yarn that has been wrapped with a binder yarn. Such wrapping, among other things, serves to increase the strength of the resulting yarn. Yarn wrapping machines are described in U.S. Pat. No. 4,472,931 to Stahlecker, U.S. Pat. No. 4,495,758 to Stahlecker et al, U.S. Pat. No. 4,484,435 to Fritjof, and U.S. Pat. No. 4,484,433 to Stahlecker et al.

In accordance with the present invention, a method and apparatus for creating randomly variegated twisted yarn is provided, in which the problem of yarn patterning is eliminated in a simple and efficient manner. The present invention includes twisting by use of a twisting device or by use of a wrapping device or both.

SUMMARY OF THE INVENTION

Briefly summarized, the present invention provides an improved method and apparatus for producing randomly variegated multiple strand yarn. According to one aspect of the method of the present invention, compressed air is delivered through spaced inlets to a supply conduit, thereby creating random air turbulence within the supply conduit, and this randomly turbulent air is supplied from the supply conduit to a chamber in a pneumatic twisting head. At least two yarns are continuously fed into the chamber, where they are randomly twisted together by the randomly turbulent air in the chamber. Preferably, the yarns are advanced through the pneumatic twisting head in an advancing direction, and the chamber has a cylindrical side wall with its axis substantially parallel to the direction in which the yarn is advanced, with air being delivered into the chamber through at least one bore which extends through the cylindrical side wall of the chamber in a generally tangential orientation. The outlet from the supply conduit is preferably located intermediate the spaced inlets to the supply conduit. Advantageously, there are a plurality of yarn twisting stations and the supply conduit is a manifold with a plurality of outlets, each outlet delivering air to one yarn twisting station.

According to a second aspect of the method of the present invention, randomly variegated multiple strand yarn is produced at a yarn twisting station where at least two yarns are continuously fed through a twisting device, the yarns are taken up from the twisting device over a traversing drum to form a yarn package, and the tension of the two yarns is varied in a random and unpredictable manner such that the twist imparted in the twisting device is random and unpredictable. Preferably, this is accomplished by rotating the traversing drum by driving it with an electric motor powered by alternating electric current, and the electrical input to the motor is varied according to a predetermined cycle which varies so as to create randomly unpredictable inertial resistance of the traversing drum to rotational speed variation, thereby creating randomly unpredictable take-up of the yarns. Preferably, there are a plurality of yarn twisting stations, each station having a traversing drum, and the traversing drums are mounted on a common shaft driven by the electric motor. The varying of the electrical input to the electric motor is preferably a stopping and restarting of the electric motor, and the dwell between stopping and restarting of the electric motor is preferably not sufficient to allow the traversing drum to come to a complete rotational stop.

According to yet another aspect of the method of the present invention, the yarn is wrapped with a binder yarn. The binder yarn is drawn from a rotating hollow spindle to wrap and twist the yarn as the yarn travels into and through the hollow spindle. This aspect of the method of the present invention is combined with either or both of the previously discussed aspects to result in a randomly variegated multiple strand wrapped yarn.

In the preferred embodiment of the method of the present invention, the aspect by which randomly turbulent air is delivered to the chamber and the aspect by which the traversing drum takes up the yarn in a randomly unpredictable manner are combined, along with the step of wrapping the yarn and the other additional features described above.

According to one aspect of the apparatus of the present invention, a supply conduit has spaced inlets into which compressed air is supplied so as to create random air turbulence in the supply conduit, the supply conduit has an outlet through which randomly turbulent air is delivered to a chamber in a pneumatic twisting head while a feeding device continuously feeds at least two yarns into the chamber, and the yarns are randomly twisted together in the chamber by the randomly turbulent air, after which take-up means act to take up the randomly twisted yarns to form a yarn package. Preferably, the feeding means, take-up means, and compressed air combine to advance the yarns through the pneumatic twisting head in an advancing direction, and the chamber has a cylindrical side wall with its axis substantially parallel to the direction in which the yarn advances, with randomly turbulent air being supplied to the chamber through at least one bore in the cylindrical side wall of the chamber, the bore being generally tangentially oriented to the side wall of the chamber. The supply conduit's outlet to the chamber is preferably located intermediate the spaced inlets to the supply conduit. There are preferably a plurality of yarn twisting stations and the supply conduit is a manifold which has a plurality of outlets, with each outlet supplying compressed air to one of the yarn twisting stations.

According to a second aspect of the apparatus of the present invention, feeding means at a yarn twisting station continuously feed at least two yarns through a twisting device, take-up means operate to take up the yarns over a traversing drum to form a yarn package, an electric motor powered by alternating electric current rotatingly drives the traversing drum, and a control device varies the electrical input to the motor according to a predetermined cycle which includes a variation of the electrical input to the motor sufficient to result in randomly unpredictable inertial resistance of the traversing drum to variation of its rotational speed, thereby creating randomly unpredictable take-up of the yarns. Preferably, there are a plurality of yarn twisting stations with a plurality of traversing drums, each drum being located at one of the stations, and the electric motor commonly drives the drums. Preferably, the traversing drums are mounted on a common shaft driven by the electric motor, while the control means operates to stop and restart the electric motor, and there is not sufficient dwell between the stopping and restarting of the motor to allow the traversing drum to come to a complete rotational stop. The control means preferably includes a cam-actuated switch with a motor for driving the cam.

According to another aspect of the apparatus of the present invention, each yarn twisting station has a means for wrapping the randomly variegated multiple strand yarn. Preferably, this means includes at least one hollow spindle, through which the yarn is fed. The hollow spindle is rotated by a driving means, and a binder yarn wound on the hollow spindle is wrapped around the multiple strand yarn as the multiple strand yarn travels into and through the hollow spindle. This aspect is combined with either or both of the previously discussed aspects of the apparatus of the present invention to result in a randomly variegated multiple strand wrapped yarn.

In the preferred embodiment of the apparatus of the present invention, the aspect by which randomly turbulent air randomly twists together the yarns in the chamber and the aspect by which the traversing drum randomly takes up the yarns are combined, along with the aspect by which the yarn is wrapped and the other additional features of the apparatus of the present invention described above.

Accordingly, the present invention provides a simple and efficient apparatus and method for producing randomly variegated multiple strand twisted yarn.

The present invention will be described in further detail below in terms of the preferred embodiment of the apparatus for producing randomly variegated multiple strand twisted yarn and the method practiced using the apparatus.

DESCRIPTION OF THE PREFERRED EMBODIMENT

Figure 1:
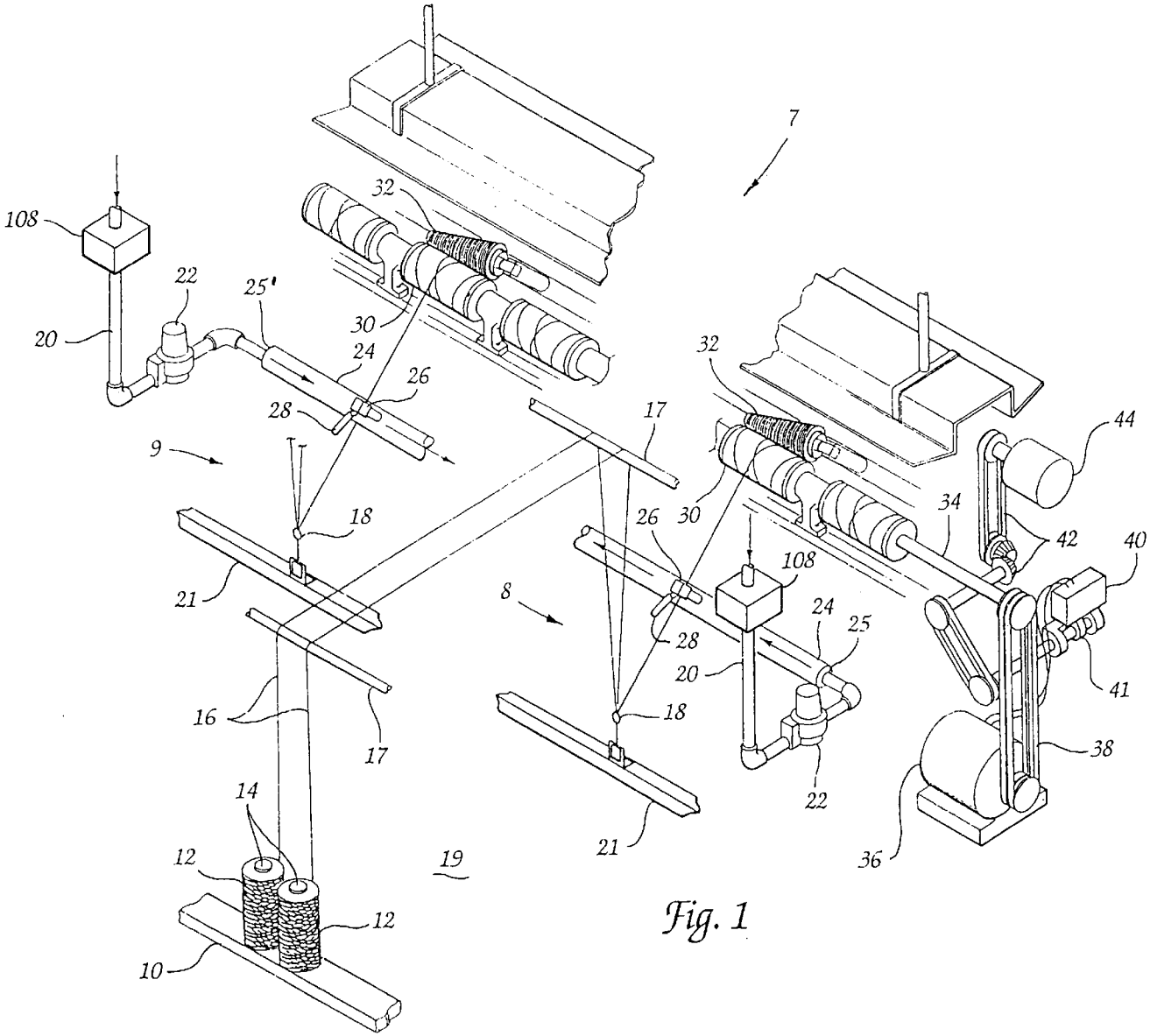
FIG. 1 is a perspective view of multiple yarn twisting stations embodying the preferred embodiment of the present invention.
Figure 2:
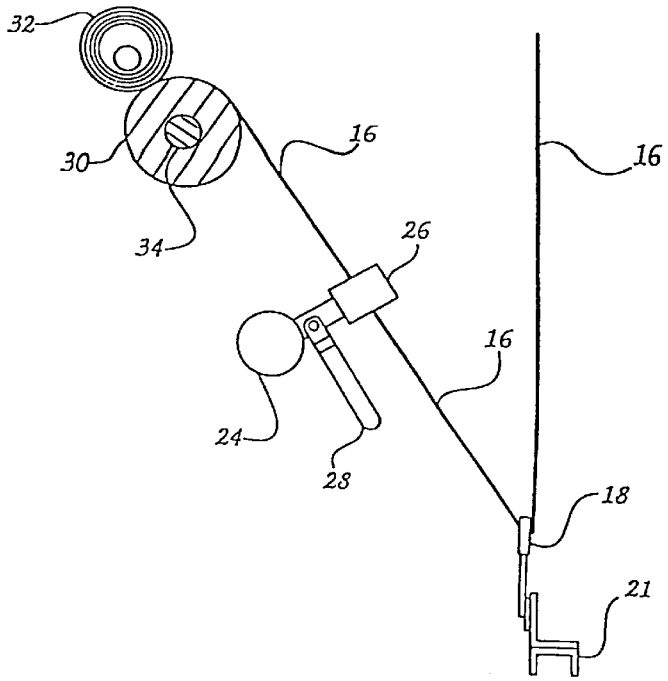
FIG. 2 is an enlarged vertical sectional view of a portion of one of the yarn twisting stations of FIG. 1.
Figure 3:
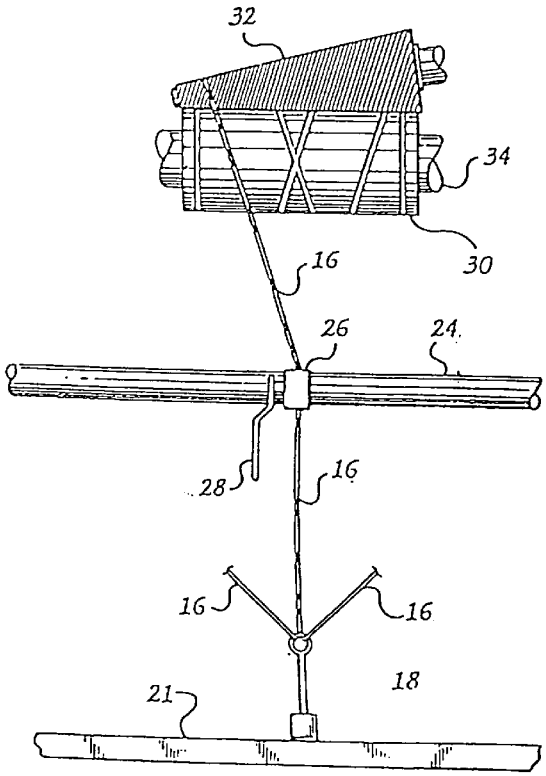
FIG. 3 is an enlarged front elevational view of a portion of the yarn twisting station illustrated in FIG. 2.

Referring now to the accompanying drawings, in FIG. 1 a yarn twisting station 8 is illustrated, along with a partial view of another yarn twisting station 9, with stations 8,9, along with a plurality of identically configured yarn twisting stations (not shown) making up a yarn twisting frame 7. Yarn twisting frame 7 includes a pair of spaced parallel lines of yarn twisting stations, one line on each side of the frame, only one line being shown. The yarn twisting stations on each side of the yarn twisting frame 7 are arranged in an in-line orientation, as shown in FIG. 1. Each yarn twisting station 8,9 is operable to twist together yarn from a plurality of yarn supply packages and wind the twisted yarn into a yarn package, and each yarn twisting station incorporates the apparatus of the present invention for randomly twisting together the yarns from the separate yarn supply packages.

At the yarn twisting station 8, yarn supply packages 12 are supported for unwinding on spindles 14 at a creel 10. The yarns 16 from the supply packages 12 are fed into the yarn twisting station 8 over spaced upper guide bars 17, thereby forming a passageway 19 thereunder through which service personnel may easily access the components of the yarn twisting station 8. The yarns 16 are then fed through eyelet 18 mounted on mounting bar 21 and from there into a pneumatic twisting head 26.

The pneumatic twisting head 26 is mounted on a manifold 24 that extends longitudinally along the extent of the twisting frame 7 and has opposed ends 25,25' beyond the first and last twisting stations on one side of the frame 7. Each twisting head 26 communicates with the interior of the manifold 24 in a manner which will be described in detail below. The manifold 24 is supplied with compressed air through its two opposed ends 25,25' by supply piping 20. Regulators 22 assist in controlling the feed of compressed air to the manifold 24. In one embodiment, the air supply is provided with a programmable timer 108, such that air pulses to the manifold 24 are staggered. Such timer 108 alternately stops the flow of air into each end 25,25' of the manifold 24. Such staggered bursts of air contribute to the randomly changing dynamics of the air turbulence in the manifold 24.

Figure 4:
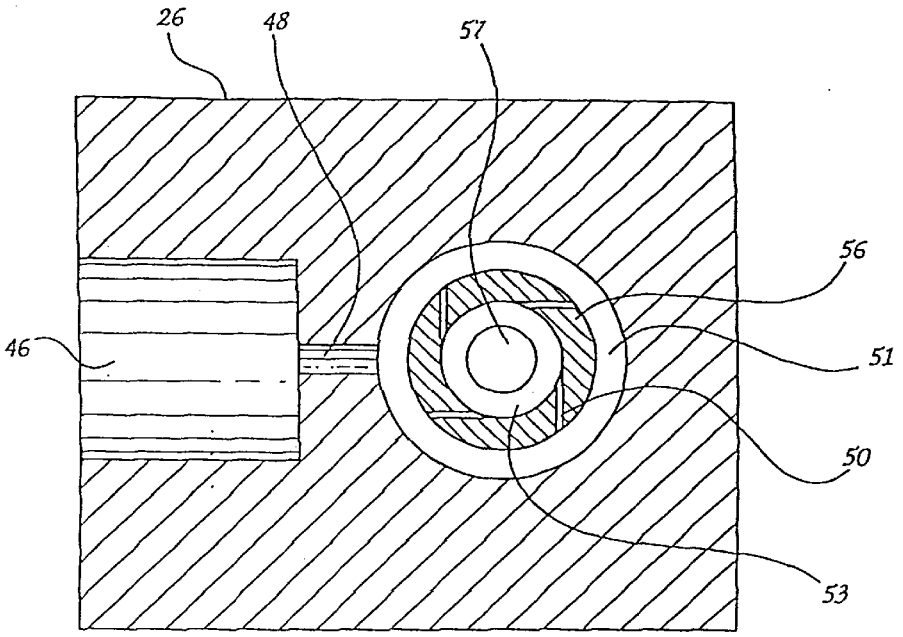
FIG. 4 is an enlarged transverse sectional view of a pneumatic twisting head included in the apparatus of FIG. 1 as viewed along line 4—4 in FIG. 5.
Figure 4A:
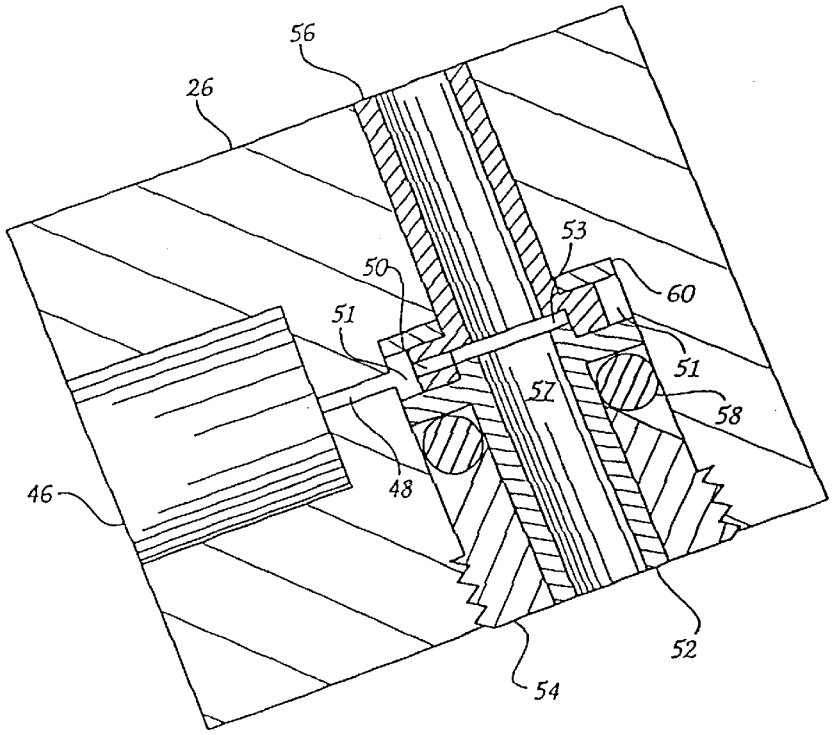
FIG. 4A is an enlarged generally longitudinal sectional view of a pneumatic twisting head included in the apparatus of FIG. 1 as viewed along line 4A—4A in FIG. 5, with the section taken so as to illustrate the full length of one of the inlet bores in the twisting head.

Turning now to FIGS. 4 and 4A, the construction of the pneumatic twisting head 26 can be seen in detail. Yarns 16 (not shown) enter the pneumatic twisting head 26 through an input sleeve 52, which is partially secured by a threaded cap 54 and an O-ring seal 58. The yarns advance through the pneumatic twisting head 26 in a yarn advancing direction. The yarns 16 (not shown) then exit the pneumatic twisting head 26 through an output sleeve 56, which is secured in place by the flange of the input sleeve 52, a sealing washer 60, and the construction of the pneumatic twisting head 26. Together, the input sleeve 52 and output sleeve 56 form a chamber 57 having a cylindrical side wall with its axis substantially parallel to the yarn advancing direction.

Compressed air from the manifold 24 enters the supply plenum 46 of the pneumatic twisting head 26, which then leads the compressed air into a supply passage 48, through which the compressed air flows into an outer annular space 51, which surrounds the flanged portion of the output sleeve 56. From the outer annular space 51, the compressed air then enters an inlet bore 50, from which it passes into an inner annular space 53, which communicates with the cylindrical chamber 57 formed by the input sleeve 52 and the output sleeve 56. The inlet bore 50 is disposed in a generally tangential relation to the chamber 57 of the pneumatic twisting head 26. In the illustrated embodiment, four inlet bores 50, which are circumferentially spaced from each other, communicate between the annular space 51 and the chamber 57 of the pneumatic twisting head 26.

Figure 5:
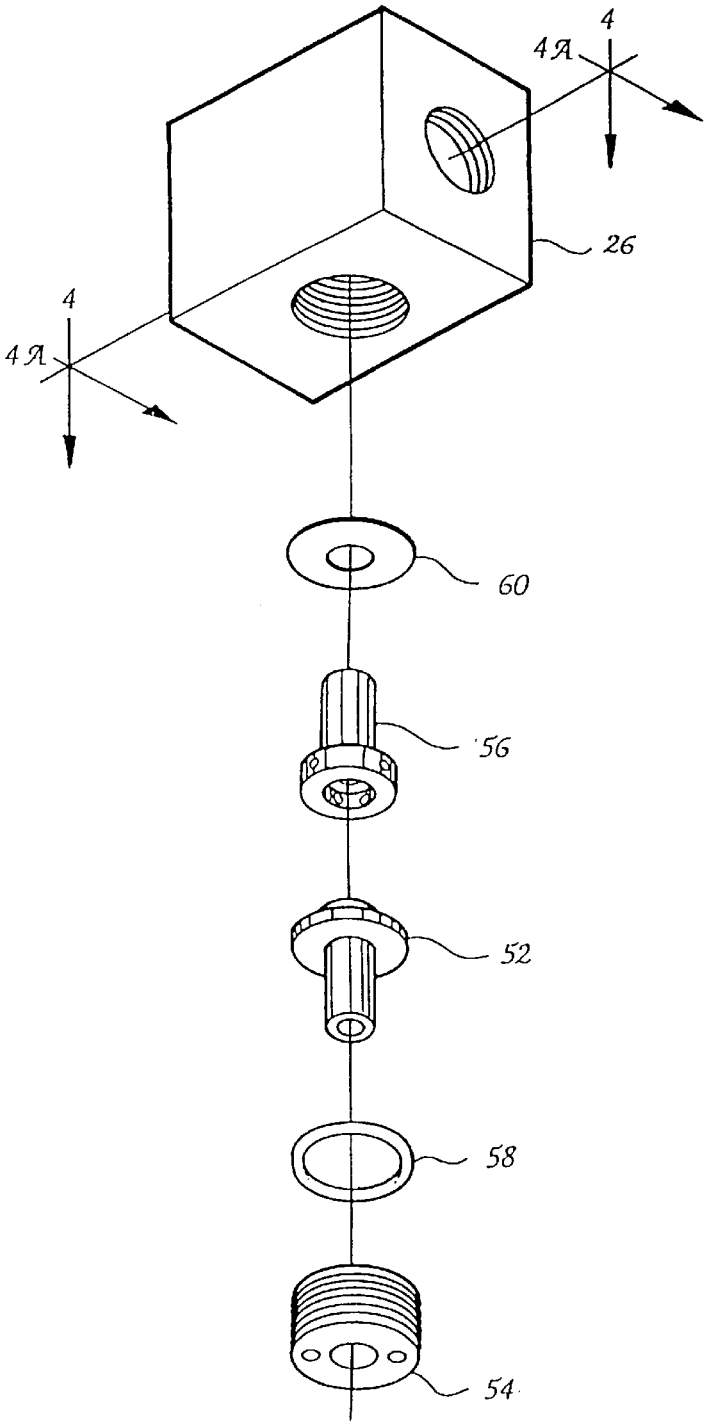
FIG. 5 is an exploded perspective view of the pneumatic twisting head of one of the twisting stations of FIG. 1.

The assembly of the items making up the pneumatic twisting head 26 is also shown in FIG. 5 in an exploded view.

Returning to FIG. 1, a shut-off valve 28 is located between the manifold 24 and the pneumatic twisting head 26 so that the compressed air supply may be shut off when necessary, for example, during doffing of a yarn package, threading of new yarns, or rethreading after a yarn break. Yarn 16 leaving the pneumatic twisting head 26 is taken up over a traversing drum 30 onto a take-up package 32. The traversing drum 30 and the mechanism (not shown) supporting yarn take-up package 32 are also conventional. The yarn take-up package 32 may be doffed, in a conventional manner, when its yarn capacity has been reached.

In a preferred embodiment, there is a device for wrapping the yarns interposed between the twisting head 26 and the traversing drum 30. The means for wrapping comprises at least one hollow spindle 100, with a binder yarn 102 wound around the outer circumference of the hollow spindle 100. The hollow spindle 100 is rotated at a constant speed by a drive means, such as a continuous loop belt 106. Preferably, all hollow spindles 100 on a multiple station machine are driven by the same continuous loop belt 106. The binder yarn 102 is wrapped on the twisted yarns 16 by the rotating motion of the hollow spindle 100 as the yarns 16 travel into and through the interior of the hollow spindle 100. The yarns 16 are drawn through the interior of the hollow spindle 100 after first contacting binder yarn 102. A guide bar 104 is provided to guide the wrapped yarns 16 to the traversing drum 30 after passing through the interior of hollow spindle 100.

Conventional wrapped yarn machines utilizing hollow spindles, such as that in Stahlecker et al '758, comprise feed and take-up rollers upstream and downstream of the hollow spindle. These rollers serve to keep the yarn tensioned as it is drawn through the interior of the hollow spindle. These rollers assist in the control of the yarns passing through the hollow spindle and aid in maintaining uniformity of the travel of the yarns. The present invention, however, dispenses with these rollers that are required by the conventional machines. Elimination of these rollers allows the yarn 16 to further twist as it enters and passes through the interior of the hollow spindle 100 and is wrapped by the binder yarn 102.

Figure 9:
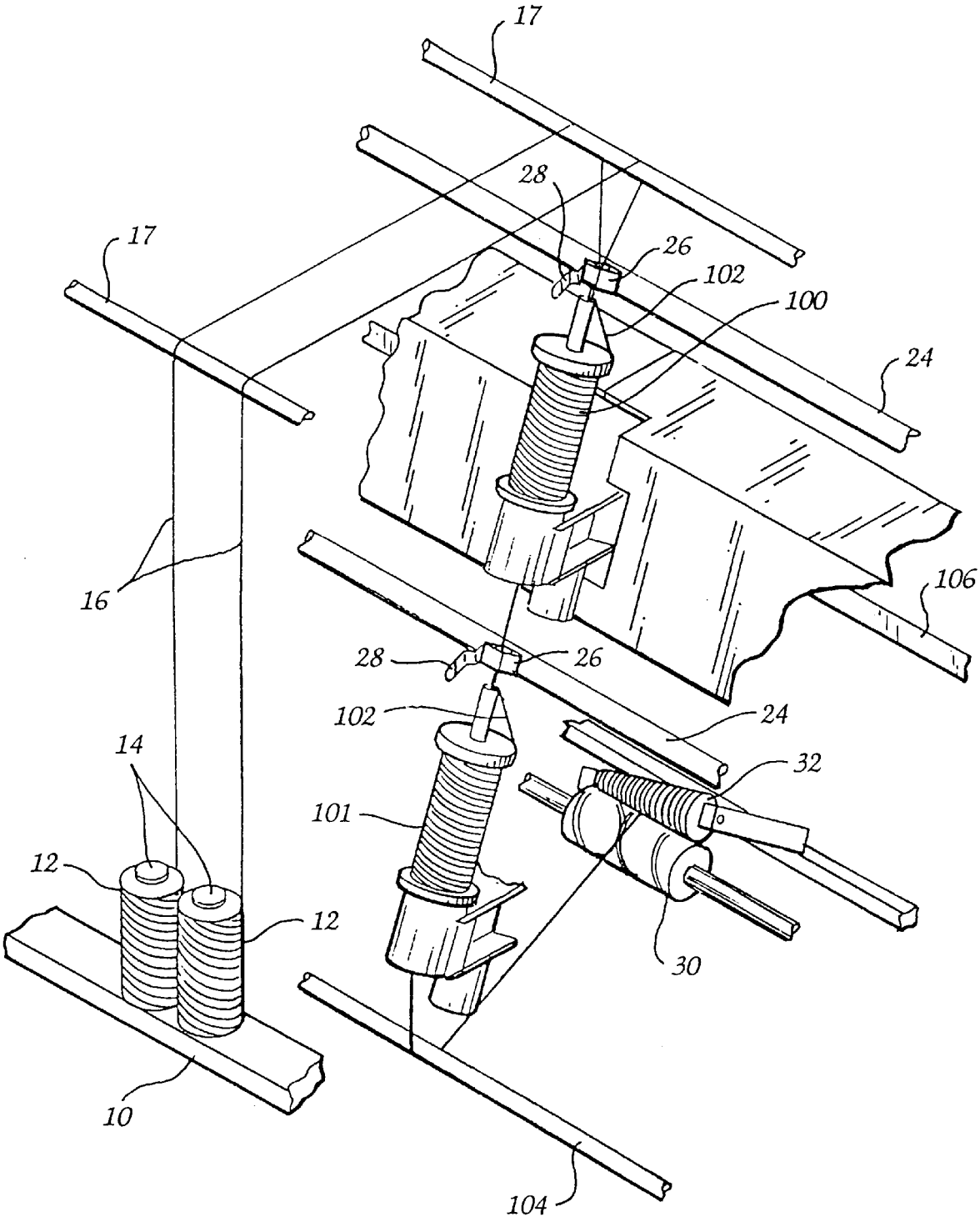
FIG. 9 is a perspective view of a yarn twisting station embodying the preferred embodiment of the present invention including a rotating hollow spindle with binder yarn wound thereon.
Figure 10:
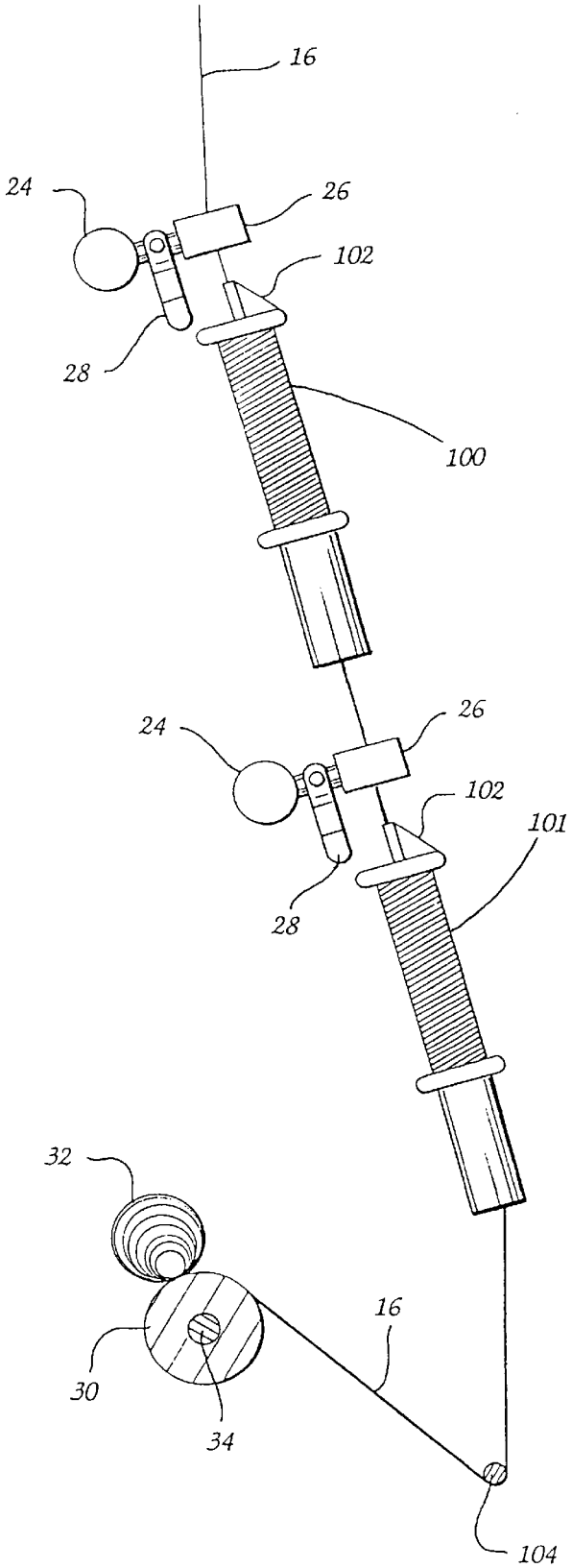
FIG. 10 is a vertical sectional view of a portion of the yarn twisting station of FIG. 9.

In a more preferred embodiment, another twisting head 26 and a second hollow spindle 101 are disposed between the first hollow spindle 100 and the traversing drum 30. The yarns 16 pass sequentially through the other twisting head 26 and the second hollow spindle 101. In this way, a faster yarn take-up speed may be achieved. Also, each hollow spindle 100,101 may be rotated in a different direction; thus, each hollow spindle 100,101 may impart a different twist (either S or Z) than the other hollow spindle 100,101, further adding to the randomness of the twist. Such configuration is illustrated in FIGS. 9 and 10.

The yarn twisting station 8 further provides a mechanism for varying the tension of the yarn as it travels through the yarn twisting station. A preferred embodiment of the tension variation mechanism is by varying the take-up of the yarns 16 by varying the speed of the traversing drum 30.

The traversing drum 30 is mounted on a shaft 34, which serves as a common shaft on which all traversing drums at all the stations on one side of the frame are commonly mounted. Shaft 34 is driven by an alternating electric current motor 36 through drive belts 38. The input of alternating electric current to the motor 36 is controlled by a control device 40, which varies the electrical input on a predetermined cycle governed by a cam-actuated switch 65 actuated by a control cam 41, which is mounted on a shaft 63 driven by an alternating electric current control motor 44 through cam drive belts and gears 42.

Figure 6:
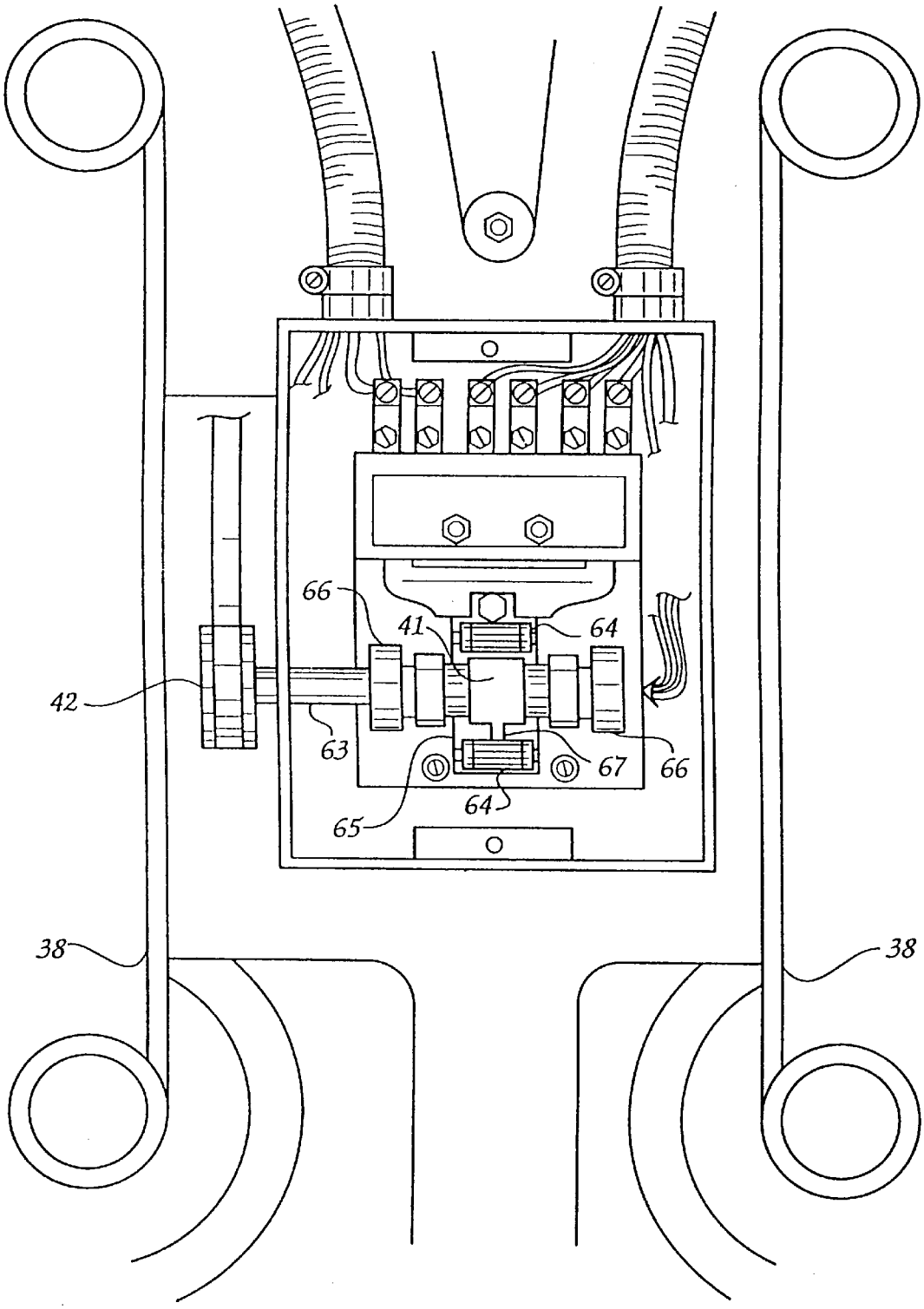
FIG. 6 is an enlarged elevational view of a cam-actuating switch mechanism for controlling the take-up of yarn in the apparatus of FIG. 1.

The details of the control device 40 are more clearly seen in FIG. 6. The control cam 41 rotates with a shaft 63, which is secured by bearings 66. As the cam 41 rotates, a lobe 67 on the cam 41 alternately contacts two opposed followers 64 and displaces them to alternately actuate and deactuate the switch 65 to alternately shut off and open the input connection of alternating electric current to the alternating electric current motor 36, depending upon which of the followers 64 is displaced by the cam 41. The predetermined cycle of shutting off and opening the input connection of alternating electric current to the motor 36 is configured so that the resulting stopping and restarting of the motor 36 allows the traversing drums 30 to maintain sufficient inertial force so that the drums 30 do not come to a complete rotational stop during the cycle. It should be understood that the control device 40 could take the form of an electronic device or any other suitable control arrangement.

In operation, compressed air supplied to the manifold 24 through the supply piping 20 enters the manifold 24 at its opposite ends 25,25', with the oppositely directed air interacting to create a swirling random air turbulence throughout the manifold 24. Yarns 16 drawn from the separate yarn supply packages 12 enter the pneumatic twisting head 26 and are fed into the chamber 57 formed by the input sleeve 52 and output sleeve 56. Randomly turbulent air from the manifold 24 enters the pneumatic twisting head 26 through the supply plenum 46, flows into the supply passage 48, the outer annular space 51, and inlet bores 50, and from there enters the inner annular space 53 and the cylindrical chamber 57 of the pneumatic twisting head 26, thereby creating randomly turbulent air currents in the chamber for randomly twisting together the yarns 16. The random air turbulence in the manifold 24 is further enhanced when one of the valves 28 is engaged to cut off air flow to one of the pneumatic twisting heads 26 mounted on the manifold 24 thereby changing the dynamics of air turbulence in the manifold 24. The valve 28 may be engaged during a rethreading operation following a yarn break or during doffing of a full yarn take-up package 32 and subsequent rethreading. Random air turbulence is further enhanced by utilization of a conventional programmable timer 108 in the air supply as discussed above.

Following the random twisting together of the yarns 16 in the pneumatic twisting head 26, the yarns 16 are wrapped with the binder yarn 102 before being passed completely through the interior of the hollow spindle 100. The binder yarn 102 on the rotating hollow spindle 100 wraps the yarns 16 as they enter and pass through the interior of hollow spindle 100. The randomly varying take-up speed of the yarn, discussed below, results in a random patternless wrapping of the yarns 16 by the binder yarn 102. In a preferred embodiment, the yarns 16 that are wrapped by the binder yarn 102 are then passed through another pneumatic twisting head 26 and through a second rotating hollow spindle 101. The yarns 16 are further wrapped by another binder yarn 102 from the second rotating hollow spindle 101.

Following the wrapping of the yarns 16 in the hollow spindle 100, the yarns 16 are, as noted previously, taken up over the traversing drum 30. Control device 40 operates, as noted above, to alternately shut off and open the connection of alternating electric current to the alternating electric current motor 36 on a predetermined cycle governed by the cam actuated switch 65 actuated by the cam 41, which is powered by the alternating current electric control motor 44. In the preferred embodiment, the cam 41 in the control device 40 actuates cam actuated switch 65 to shut off and open the connection of alternating electric current to the motor fifty times per minute, it being understood that other predetermined cycles for the control device 40 may be employed so long as the traversing drum 30 is not allowed to come to a rotational stop during the operational cycle. The coasting action of the alternating electric current motor 36 which ensues once electric current to the motor 36 is shut off, and the varying inertial forces inherent in the traversing drums 30 result in the traversing drums 30 having a randomly unpredictable cumulative inertial resistance to variation of rotational speed, which therefore creates a randomly unpredictable take-up of yarns 16 on the traversing drum 30, which causes yarn 16 to lose the false twist imparted to it in the pneumatic twisting head 26 at a randomly unpredictable rate because of the randomly unpredictable change in the tension of the yarn by changing the speed of yarn take-up. It should be understood that randomly unpredictable take-up of the yarns 16 on a traversing drum 30, and the associated change of tension, could be created by varying the electrical input to alternating electric current motor 36 without shutting off and starting the electrical input and that variation of the electrical input could be accomplished by varying the voltage, frequency, or any other suitable means. It should also be noted that a variety of motors could be used to create this effect.

The random variation in the tension of the yarns 16 may also be produced using conventional tension control devices with modified control that imposes a random, unpredictable variation in tension. These known tension control devices are generally used to ensure that tension is kept at a constant, and any measured deviation in yarn tension is used as input for modification of the yarn tension to maintain a predetermined tension value. Generally, this is accomplished by use of a controller in communication with a tension measuring device and a tensioning device. It will be apparent to one with skill in the art that the controller may be programmed to provide randomly unpredictable yarn tension variation, instead of returning the tension to a predetermined amount. It is also within the spirit of the invention to use simpler tension randomization devices, such as providing a series of pegs or eyelets past which the yarn travels, and randomly moving one or more pegs or eyelets transversely to vary the tension in the yarn. This type of tension control may be used with each individual yarn or with both yarns together. Use of separate yarn tensioning randomization devices compounds the randomization of the randomly variegated multiple strand twisted yarn.

It is also apparent that an unpredictable randomization of the yarn tension can be used to produce randomly variegated twisted yarn other than using the specific randomized pneumatic twisting head apparatus discussed above. Use of any twisting device, such as a rotating hollow spindle discussed below or any conventional twisting device with the randomization of the yarn tension will provide randomly variegated twisted yarn according to the present invention. Use of more than one randomized device or method, such as the unique pneumatic twisting head arrangement discussed above or the variably rotating hollow spindle discussed in greater detail below, or any other randomization device or method will compound the unpredictable random twist of the yarns 16 that is the desirable result of the present invention. It is also contemplated that individually varying the tension of each of the yarns to be fed to the yarn twisting station 8 will further compound the unpredictable random twist imparted to the yarns 16.

Figure 7:
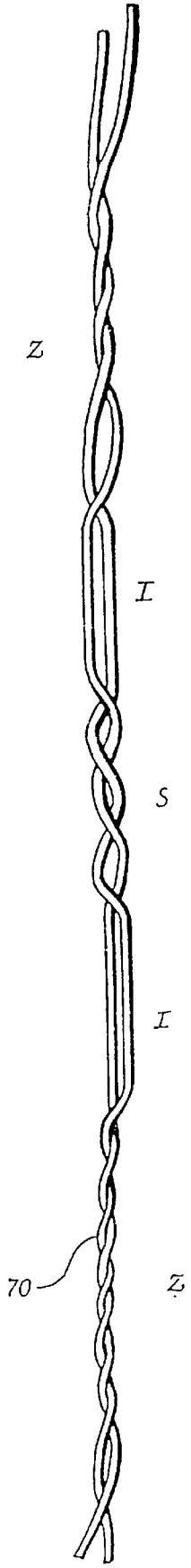
FIG. 7 is a view of randomly twisted yarn produced by a yarn twisting station embodying the present invention.

A length of typical randomly variegated multiple strand yarn produced by the method of the preferred embodiment of the present invention using the apparatus of the preferred embodiment of the present invention is seen in FIG. 7, in which the yarn 70 displays the randomly varying twist characteristic of yarns produced by the present invention. Reversal of the twist in the yarn, which changes from Z-twist to S-twist and then back to Z-twist again, can also be clearly seen in FIG. 7, and is additionally characteristic of yarn produced by the present invention. The reversal of twist occurs as yarn exits the pneumatic twisting head and begins to lose some of the false twist imparted to it in the twisting head. The amount of twist imparted to the yarn varies randomly along the length of the yarn, and more 10 highly twisted sections, Z-twist sections indicated by the letter Z in FIG. 7, tend to untwist more rapidly and with greater force. This untwisting affects areas along the length of the yarn downstream from the untwisting sections up to the traversing drum and may cause sections which have been more loosely twisted to continue to "untwist" until they become reversely twisted, as indicated by the letter S in FIG. 7, in the reverse direction from the twist imparted by the twisting head with intermediate lengths, as indicated by the letter I in FIG. 7, being substantially without twist.

Figure 8:
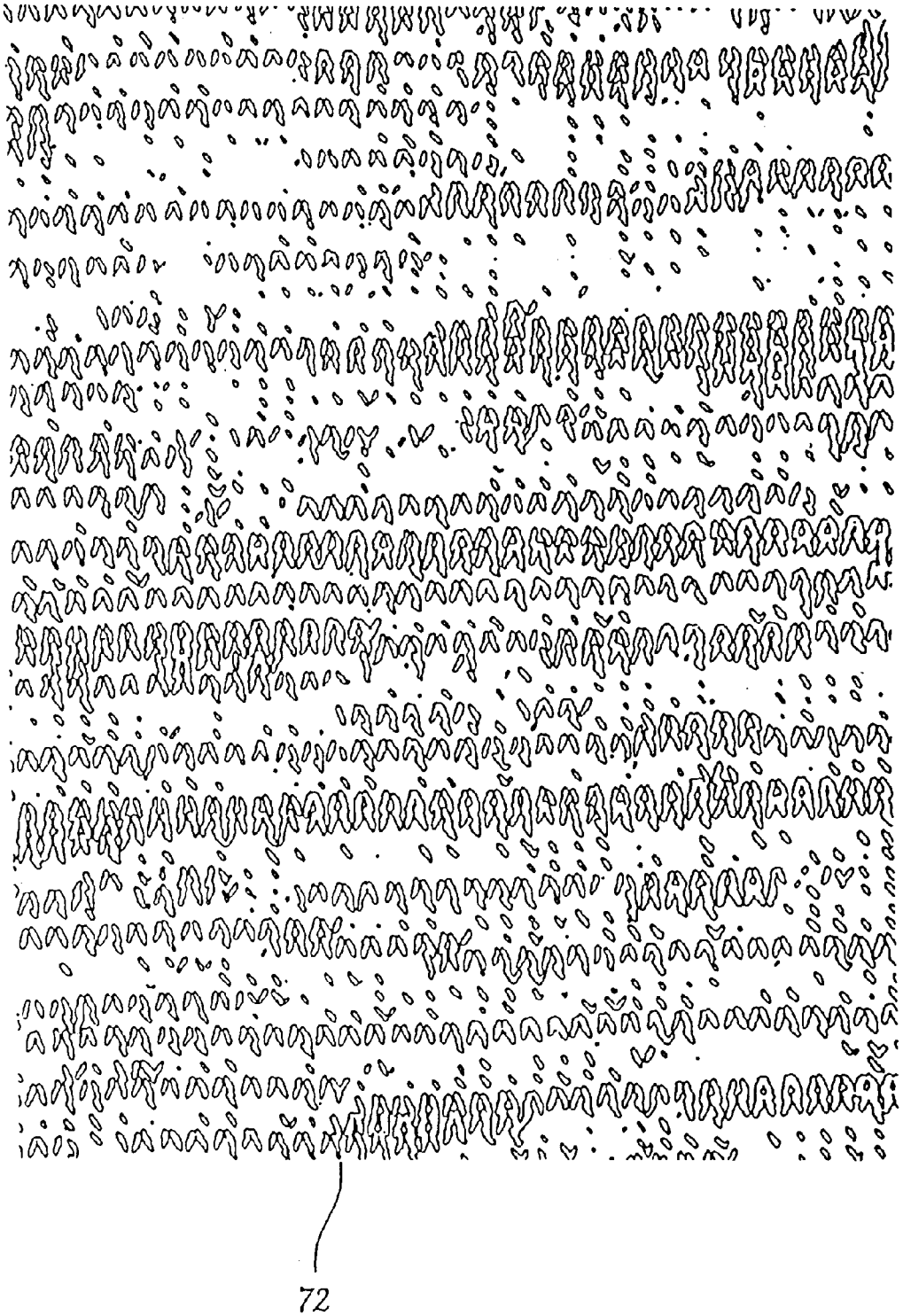
FIG. 8 is a view of a portion of knitted fabric composed of yarn produced by a yarn twisting station embodying the present invention.

In FIG. 8 is illustrated a sample of knitted cloth using yarns produced by the present invention. The randomly variegated appearance of the cloth 72 is characteristic of textile products produced by the present invention. Cloth 72 produced with yarn such as yarn 70 will also have a soft texture or hand as a result of the randomly varying twist on yarn 70, on which a significant number of areas will have a low number of twists per inch in either direction or no twist. When yarn 70 is knitted or woven into cloth, these areas of low or no twist along the yarn give the cloth a soft and yielding texture which is pleasing and desirable.

In FIG. 9 is illustrated an embodiment of the present invention wherein the yarns 16 pass through at least one rotating hollow spindle 100. When the yarns 16 contact an interior surface of the rotating hollow spindle 100, the friction from this contact with the rotating interior surfaces causes some amount of twist in the yarns 16. The amount of the resulting twist is dependent on the inner diameter of the rotating hollow spindle 100 relative to the diameters of the yarns 16. Also, transverse displacement of the hollow spindles 100 relative to the path of travel of the yarns 16 will affect the amount of twist imparted. For example, if the hollow spindle 100 is displaced such that the yarns 16 travel directly through the center of the hollow spindle 100, there will be limited contact by the yarns 16 with the interior surface of the hollow spindle 100 and, thus, limited friction to impart twist. On the other hand, if the hollow spindle 100 is displaced transversely with respect to the path of travel of the yarns 16, such that there is substantial contact of the yarns 16 against the interior surface of the hollow spindle 100, there will be enhanced friction resulting in enhanced twist imparted to the yarns 16. It will be apparent that variation of this transverse displacement will vary the amount of twist imparted to the yarns 16.

In FIG. 9 is illustrated another embodiment of the present invention wherein at least one rotating hollow spindle 100 having a binder yarn 102 wound thereon is used to wrap the yarns 16 with the binder yarn 102. The use of two hollow spindles 100,101 provides adequate wrap cover of the twisted yarn at faster take-up speeds than when wrapping the yarn with one hollow spindle 100, thus increasing productivity. Further, each hollow spindle 100,101 may be rotated in a different direction, such that the wrapping by the binder yarn from one hollow spindle 100,101 imparts an S-twist to the yarns 16 as they are wrapped, and the wrapping by the binder yarn from the other hollow spindle 100,101 imparts a Z-twist to the yarns 16 as they are wrapped. Thus, in combination, the randomness of the air turbulence in the manifold 24 and the varying of the speed of the take-up yarn over the traversing drum 30 creates an enhanced randomness in the wrap of the binder yarn 102 over the yarns 16. It is to be further noted that the use of at least one rotating hollow spindle 100 in conjunction with accompanying random yarn tension variation, such as by varying of the speed of the traversing drum 30, is sufficient to impart a random twist to the yarns 16 as they are wrapped by the binder yarn 102. Such randomness also produces a randomly variegated multiple strand wrapped yarn, without the use of the pneumatic twisting head 26. It is to be noted that, without the use of the pneumatic twisting head 26, the twist is all in either the S or Z direction, the random S/Z-twists discussed above do not occur when the pneumatic twisting head 26 is not utilized. In the preferred embodiment, the pneumatic twisting head 26, the varying speed traversing drum 30, and wrapping the twisted yarn 16 with binder yarn 102 from the rotating hollow spindles 100,101 are used to create the randomly variegated multiple strand twisted and wrapped yarn.

The rotating hollow spindle 100 may also be driven in a manner similar to that described above for the traversing drum 30. Thus, the spindle 100 is rotated at unpredictable random speeds or intermittently stopped and started so that the twist imparted to the yarns 16 by either the friction with the interior surface of the rotating hollow spindle 100, the wrapping by binder yarn 102, or both, is unpredictably random and may be used in conjunction with or separate from the other methods/devices discussed to yield a randomly variegated multiple strand twisted yarn.

The binder yarn 102 may be of any fiber, such as wool, or any continuous filament, such as polyester or selected from material known as metallics, or from other synthetic materials, such as polyethylene terephthalate, or Mylar®. In one embodiment, it is intended that the binder yarn 102 be relatively inconspicuous compared to the yarns 16. Thus, it is the yarns 16 that exhibit the desired aesthetic qualities, while binder yarn 102 imparts additional qualities such as strength and cohesiveness and locks in the false twist imparted by the methods and apparatus of the present invention. The binder yarn 102 locks in this false twist because the wrapping of yarns 16 by the binder yarn 102 prevents any unraveling of the false twist. In other embodiments, the binder yarn 102 may add to the aesthetic qualities, such as enhancing the color or the texture, and thus not be relatively inconspicuous.

The use of the present apparatus and method for producing randomly variegated multiple strand twisted and wrapped yarn and the yarn and fabric made by the method is particularly advantageous when the yarns 16 are cotton yarns and the binder yarn 102 is chosen to be a thread that can be heat set or melted. This enables one to create a randomly variegated multiple strand twisted and wrapped cotton yarn of more than one color that can be heat set or have the binder yarn 102 melted to promote the cohesiveness of the cotton fabric. The process of heat setting or melting of the binder yarn occurs after the wrapped twisted yarn 16 is taken up on the take-up package 32. In yet another embodiment, the binder yarn 102 is water soluble and will disappear after washing the article in which the yarns are ultimately placed.

It is to be recognized that the size of the yarns 16 or the binder yarn 102 is not limiting to the invention. With properly sized equipment, any size yarns 16 or binder yarn 102 can be accommodated. It is contemplated that the size of binder yarn 102 is either smaller, equal to, or larger than the size of yarns 16, depending upon the desired properties of the wrapped twisted yarn and the available materials. Likewise, the inner diameter of the rotating hollow spindle is also not limiting to the invention and may be selected based on the specific configuration desired and the particular amount of twist desired to be imparted by contact of the yarns 16 with the interior surface of the rotating hollow spindle.

One function of the binder yarn 102 is to bind the yarns 16 together. Another function is to lock in the false twist imparted by the unpredictable and random false twist method and apparatus of the present invention. This will ensure that the false twist does not unravel between the twisting device and the yarn take-up package 32 or during subsequent use of the randomly variegated multiple strand twisted yarn. The binder yarn 102 may be of any size and may be permanent, such as to add color, or temporary, such as if water soluble or having a low melt point. The specific characteristics and properties of the binder yarn 102 are variable to accommodate the desired end use of the wrapped twisted yarn and the materials available for use as a binder yarn. Such flexibility is an advantageous characteristic of the present invention.

It is to be noted that the present invention may be accomplished by providing twist with a pneumatic twisting head, a rotating hollow spindle, wrapping of the yarn, or any other twisting device. The unpredictable randomness to the twist may be accomplished by varying the yarn tension, such as discussed with reference to varying the speed of the traversing drum, providing random air turbulence to a pneumatic twisting head, or by randomly varying the rotational speed of the rotating hollow spindles. It will be apparent that any combination of the foregoing yarn twisting and randomization devices and methods may be utilized according to the present invention to obtain a desired randomization effect.

The unique method and apparatus of the present invention for producing randomly variegated multiple strand yarn has several advantages. In the yarn twisting station 8 of the present invention, the twisting together of yarns 16 may be randomized by at least two aspects, the random turbulence of the compressed air introduced into the pneumatic twisting head 26 and the randomly unpredictable rotational speed of the traversing drum 30. These two aspects interact to completely randomize the twisting together of yarns 16 and operate in such a way that wear on the components of the system does not tend to reduce the randomizing action of the two aspects. Other combinations of randomization produce similarly unpredictable results. The present invention's method and apparatus for random twisting together of yarn is of significant benefit to the textile industry in that it prevents the serious problem of yarn patterning from arising allowing textile products with a truly randomly variegated appearance to be produced, resulting in textile products with attractive and unique appearances and textures.

The amount of twist in the yarn taken up on the package 32 may be varied by adjusting the pressure of the compressed air delivered to the manifold 24, thereby resulting in a change in the average pressure of the air flowing into the chamber 57 through the bores 50 and consequently varying the turbulence of the air twisting the yarns 16 in the chamber 57. The amount of twist in the yarn taken up on the package 32 may also be adjusted by increasing or decreasing the operating speeds of the alternating electric current motor 36, which imparts greater or lesser speed to the traversing drums 30 through the shaft 34, and by increasing or decreasing the distance between the traversing drums 30 and pneumatic twisting heads 26. Likewise, modification of the speed of the motor driving the rotating hollow spindles 100,101 or the distances between the twisting heads 26, the rotating hollow spindles 100,101, and the traversing drums 30 will vary the amount of twist imparted to and retained in the yarns 16.

Although the present invention has been illustrated herein with two yarn supply packages supplying yarn to the yarn twisting station 8, it should be understood that three or more yarn packages could be employed to supply yarn at each yarn twisting station. The chamber 57 in the pneumatic twisting head 26 can be made larger or smaller to accommodate greater or lesser numbers of yarn to be twisted together or to accommodate larger or smaller sized yarns.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for producing variegated multiple strand twisted yarn from yarns, comprising passing the yarns through a first rotating hollow spindle with a sufficient lack of tension to cause random frictional contact of the yarns only with an interior surface of the first rotating hollow spindle between opposed ends thereof, the frictional contact imparting a random false twist to the yarns.

2. The method of claim 1, wherein the first hollow spindle includes a supply of binder yarn carried thereon, and further comprising the step of feeding the binder yarn from the first hollow spindle into the interior thereof and wrapping the binder yarn around the yarns passing therethrough whereby the random false twist is locked into the yarns by the binder yarn.

3. The method of claim 1, further comprising randomly varying the tension of the yarns being passed through the first rotating hollow spindle such that the false twist imparted to the yarns is further randomized.

4. The method of claim 3, further comprising the step of randomly rotating the first hollow spindle such that the false twist imparted to the yarns if further randomized.

5. The method of claim 3, wherein the first hollow spindle includes a supply of binder yarn carried thereon, and further comprising the step of feeding the binder yarn from the first hollow spindle into the interior thereof and wrapping the binder yarn around the yarns passing therethrough whereby the random false twist is locked into the yarns by the binder yarn.

6. The method of claim 3, wherein the first hollow spindle includes a supply of binder yarn carried thereon, and further comprising the step of imparting a further random false twist to the yarns by wrapping the yarns with a binder yarn drawn from the supply of binder yarn carried on the first rotating hollow spindle.

7. The method of claim 3, further comprising, following said step of passing the yarns through the first hollow spindle, (i) passing the yarns through a second hollow spindle rotating in a direction opposite that of the first hollow spindle, and (ii) causing random frictional contact of the yarns only with an interior surface of the second rotating hollow spindle thereby imparting a further random false twist to the yarns.

8. The method of claim 1, further comprising displacing the first hollow spindle relative to the yarns in a direction transverse to a direction of the yarns passing therethrough.

9. The method of claim 1, further comprising the step of randomly rotating the first hollow spindle such that the false twist imparted to the yarns is further randomized.

10. The method of claim 9, wherein the first hollow spindle includes a supply of binder yarn carried thereon, and further comprising the step of feeding the binder yarn from the first hollow spindle into the interior thereof and wrapping the binder yarn around the yarns passing therethrough whereby the random false twist is locked into the yarns by the binder yarn.

11. The method of claim 9, wherein the first hollow spindle includes a supply of binder yarn carried thereon, and further comprising the step of imparting a further random false twist to the yarns by wrapping the yarns with a binder yarn drawn from the supply of binder yarn carried on the first rotating hollow spindle.

12. The method of claim 9, further comprising, following said step of passing the yarns through the first hollow spindle, (i) passing the yarns through a second hollow spindle rotating in a direction opposite that of the first hollow spindle, and (ii) causing random frictional contact of the yarns only with an interior surface of the second rotating hollow spindle thereby imparting a further random false twist to the yarns.

13. The method of claim 9, further comprising displacing the first hollow spindle relative to the yarns in a direction transverse to a direction of the yarns passing therethrough.

14. The method of claim 1, further comprising, following said step of passing the yarns through the first hollow spindle, (i) passing the yarns through a second hollow spindle rotating in a direction opposite that of the first hollow spindle, and (ii) causing random frictional contact of the yarns only with an interior surface of the second rotating hollow spindle thereby imparting a further random false twist to the yarns.

15. The method of claim 14, wherein the first hollow spindle includes a supply of binder yarn carried thereon, and further comprising the step of feeding the binder yarn from the first hollow spindle into the interior thereof and wrapping the binder yarn around the yarns passing therethrough whereby the random false twist is locked into the yarns by the binder yarn before passing the yarns through the second hollow spindle.

16. The method of claim 1, further comprising displacing the first hollow spindle relative to the yarns in a direction transverse to a direction of the yarns passing therethrough.

17. The method of claim 16, wherein the first hollow spindle includes a supply of binder yarn carried thereon, and further comprising the step of feeding the binder yarn from the first hollow spindle into the interior thereof and wrapping the binder yarn around the yarns passing therethrough whereby the random false twist is locked into the yarns by the binder yarn.

18. The method of claim 16, wherein the first hollow spindle includes a supply of binder yarn carried thereon, and further comprising the step of imparting a further random false twist to the yarns by wrapping the yarns with a binder yarn drawn from the supply of binder yarn carried on the first rotating hollow spindle.

19. The method of claim 16, further comprising, following said step of passing the yarns through the first hollow spindle, (i) passing the yarns through a second hollow spindle rotating in a direction opposite that of the first hollow spindle, and (ii) causing random frictional contact of the yarns only with an interior surface of the second rotating hollow spindle thereby imparting a further random false twist to the yarns.

20. A method for producing variegated multiple strand twisted yarn from yarns, comprising passing the yarns through a first rotating hollow spindle which includes a supply of binder yarn carried thereon, feeding the binder yarn from the first hollow spindle into the interior thereof and wrapping the binder yarn around the yarns passing therethrough whereby a false twist is locked into the yarns by the binder yarn, and, following said step of passing the yarns through the first hollow spindle, passing the yarns with a sufficient lack of tension through a second hollow spindle rotating in a direction opposite that of the first hollow spindle, and to cause random frictional contact of the yarns only with an interior surface of the second rotating hollow spindle between opposed ends thereof, the frictional contact imparting a random false twist to the yarns.

21. The method of claim 20, further comprising the step of randomly rotating the first hollow spindle.

22. The method of claim 20, further comprising displacing the first hollow spindle relative to the yarns in a direction transverse to a direction of the yarns passing therethrough.

23. A method for producing variegated multiple strand twisted yarn from yarns, comprising passing the yarns through a first rotating hollow spindle with a sufficient lack of tension to cause random frictional contact of the yarns only with an interior surface of the first rotating hollow spindle between opposed ends thereof, the frictional contact imparting a false twist to the yarns, and a step for randomizing the false twist.

24. An apparatus for producing variegated multiple strand twisted yarn from yarns, comprising a rotatable hollow spindle defining a travel path through which yarns are fed and means for causing engagement of the yarns with the spindle only in random frictional contact with an interior surface of the spindle between opposed ends thereof such that a random false twist is imparted to the yarns passing therethrough when the spindle is rotating.

25. The apparatus of claim 24, further comprising a rotational traversing drum for take-up of the false twisted yarns to form a yarn package, a motor for driving rotation of said traversing drum, and a controller for controlling said motor such that said traversing drum is driven at random rotational speeds whereby the tension in the yarns is randomly varied.

26. The apparatus of claim 25, further comprising a motor operatively engaged with said hollow spindle for driving rotation thereof, and a controller in communication with said motor for randomly varying the speed of the motor to randomly vary the rotational speed of the hollow spindle.

27. The apparatus of claim 25, wherein said hollow spindle further includes a supply of binder yarn that feeds into the interior of said hollow spindle to wrap the yarns passing therethrough and to lock a false twist imparted therein.

28. The apparatus of claim 25, further comprising a second rotatable hollow spindle defining a travel path through which the yarns are fed in random frictional contact with an interior surface thereof such that a further random false twist is imparted to the yarns passing therethrough.

29. The apparatus of claim 24, further comprising a motor operatively engaged with said hollow spindle for driving rotation thereof, and a controller in communication with said motor for randomly varying the speed of the motor to randomly vary the rotational speed of the hollow spindle.

30. The apparatus of claim 29, further comprising a second rotatable hollow spindle defining a travel path through which the yarns are fed in random frictional contact with an interior surface thereof such that a further random false twist is imparted to the yarns passing therethrough.

31. The apparatus of claim 29, wherein said hollow spindle further includes a supply of binder yarn that feeds into the interior thereof to wrap the yarns passing therethrough and for locking a false twist in the yarns.

32. The apparatus of claim 24, wherein said hollow spindle further includes a supply of binder yarn that feeds into the interior of said hollow spindle to wrap the yarns passing therethrough and to lock a false twist imparted therein.

33. The apparatus of 32, further comprising a second rotatable hollow spindle defining a travel path through which the yarns are fed in random frictional contact with an interior surface thereof such that a further random false twist is imparted to the yarns passing therethrough.

34. The apparatus of 24, further comprising a second rotatable hollow spindle defining a travel path through which the yarns are fed in random frictional contact with an interior surface thereof such that a further random false twist is imparted to the yarns passing therethrough.

35. The apparatus of 24, further comprising means for further randomizing the false twist imparted to the yarns by said rotating hollow spindle.

36. An apparatus for producing variegated multiple strand twisted yarn from yarns, comprising a rotatable hollow spindle defining a travel path through which yarns are fed, said hollow spindle including a supply of binder yarn that feeds into the interior thereof to wrap the yarns passing therethrough for locking a false twist in the yarns; and a second rotatable hollow spindle defining a travel path through which the yarns are fed and means for causing engagement of the yarns with the second spindle only in random frictional contact with an interior surface of the second spindle between opposed ends thereof such that a random false twist is imparted to the yarns passing therethrough when the second spindle is rotating.

37. The apparatus of claim 36, further comprising a motor operatively engaged with said hollow spindle for driving rotation thereof, and a controller in communication with said motor for randomly varying the speed of the motor to randomly vary the rotational speed of said hollow spindle.

* * * * *